US005518483A

United States Patent [19]

Oswald

[11] Patent Number: 5,518,483

[45] Date of Patent: May 21, 1996

[54] PORTABLE PUSH-PULL TYPE EXERCISE DEVICE

[76] Inventor: John C. Oswald, 1342 W. Detroit Blvd., Pensacola Escambia, Fla. 32534

[21] Appl. No.: 236,985

[22] Filed: May 10, 1994

[51] Int. Cl.[6] ..... A63B 21/00

[52] U.S. Cl. ..... 482/131; 482/130; 482/114

[58] Field of Search ..... 482/51, 123, 131, 482/128, 129, 114, 907, 72, 71, 148, 110, 53–56, 148

[56] References Cited

U.S. PATENT DOCUMENTS 3,101,944 8/1963 Cencig .
3,572,701 5/1969 Agamian .
3,589,720 10/1969 Agamian .
4,506,884 3/1985 Hankin ..... 482/131
4,653,749 3/1987 Rorabaugh ..... 482/51
4,930,769 6/1990 Nenoff .
5,295,935 3/1994 Wang ..... 482/123
5,328,427 7/1994 Sleamaker ..... 482/51

*Primary Examiner*—Jerome Donnolly
*Attorney, Agent, or Firm*—Peter Loffler

[57] ABSTRACT

An exercise device of the push-pull type is disclosed. The device consists of a pair of parallel channels, knee rest unit, and hand grip unit. Either the hand grip unit and the knee rest unit can slide freely along the length of the channels, while the other unit is held stationary. Both the knee rest unit and hand grip unit have user-variable resistance means. The invention may be disassembled and folded for easy storage and transportation.

5 Claims, 6 Drawing Sheets

PORTABLE PUSH-PULL TYPE EXERCISE DEVICE

BACKGROUND OF THE INVENTION

1. Field of the Invention

This invention generally relates to exercise equipment and particularly to exercise equipment of the push-pull type wherein a person using the equipment pushes and extends his body out and thereafter pulls and retracts his body back in.

2. Background of the Prior Art

Exercise devices of the push-pull type wherein a user pushes and extends his body out and thereafter pulls and retracts his body back in, are well known in the art. U.S. Pat. No. 3,101,944 issued to Cencig, U.S. Pat. No. 3,572,701 issued to Agamian (Agamian I), U.S. Pat. No. 3,589,720 issued to Agamian (Agamian II), and U.S. Pat. No. 4,930,769 issued to Nenoff, all disclose various embodiments of these types of exercise devices.

While the above patents provide the user with a physical workout, each suffers from one or more shortcomings. The Cencig invention provides a knee rest and hand grips. However, the invention only permits the hand grips to slide freely, keeping the knee rest stationary, thereby reducing the number of body muscles that can receive a workout.

The Agamian I invention does not permit kneeling while exercising, thereby reducing user comfort. Furthermore, the invention cannot be easily stored and transported.

The Agamian II invention suffers the same shortcomings as Agamian I and furthermore, is relatively complex to construct.

The Nenoff invention only permits the knee rest to slide freely, thereby reducing the number of body parts that can be exercised. Additionally, the invention is not very compact and is therefore not easy to store or transport.

What is needed is a push-pull type exercise device that overcomes the above shortcomings. The invention must permit a large number of body parts to be exercised. Furthermore, the device must be comfortable. The invention must be easy to store and transport and must be relatively easy to construct.

SUMMARY OF THE INVENTION

The exercise device of the present invention meets the above needs. It is a push-pull type exercise devise that is composed of a pair of channels disposed in parallel relation. A knee rest unit and a hand grip unit are each positioned within the channels at opposite ends. The knee rest unit and the hand grip unit can each slide freely along the length of the channels or be stationary as required.

The user can adjust the sliding resistance of either the knee rest unit or the hand grip unit depending on which is sliding freely. The hand grip unit and the knee rest unit are each padded for user comfort. The device is easy to use.

The invention can be quickly and easily disassembled and folded for easy storage and transportation. The present invention is of relatively simple construction.

Therefore, it is an object of the present invention to provide an exercise devise of the push-pull type that will exercise a large number of body parts.

It is another object of the present invention to provide an exercise devise of the push-pull type that is comfortable and easy to use.

It is another object of the present invention to provide an exercise devise of the push-pull type that is easy to store and transport.

It is a final object of the present invention to provide an exercise devise of the push-pull type that is relatively easy to manufacture and construct.

DETAILED DESCRIPTION OF THE PREFERRED EMBODIMENT

Figure 1:
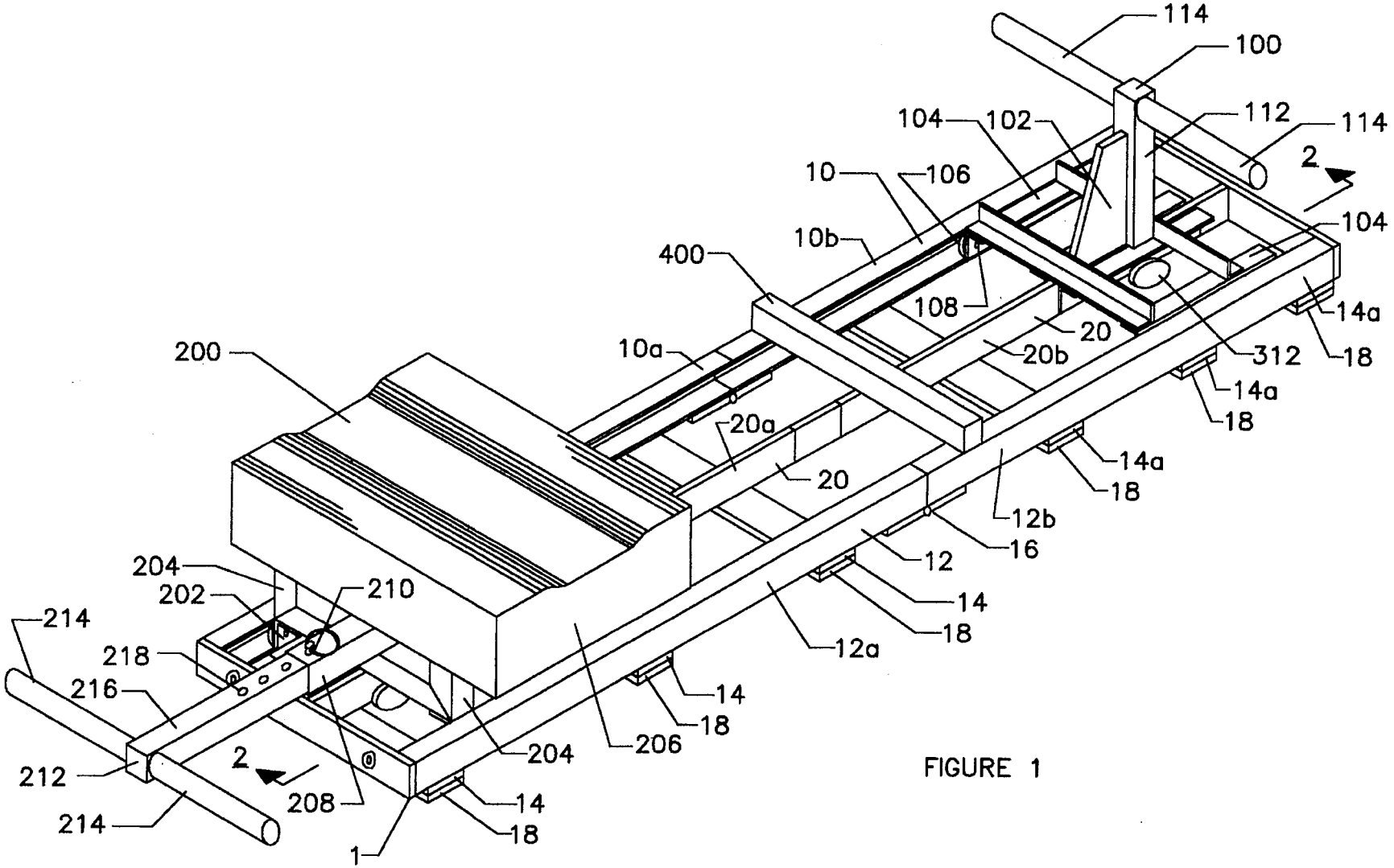
FIG. 1 is a perspective view of the exercise device of the present invention.

Referring now to FIG. 1 which shows the exercise device of the present invention 1 consists of a first channel 10 and a second channel 12. The first channel 10 is composed of two channel components 10*a* and 10*b*. The second channel 12 is also composed of two channel components 12*a* and 12*b*.

Figure 2:
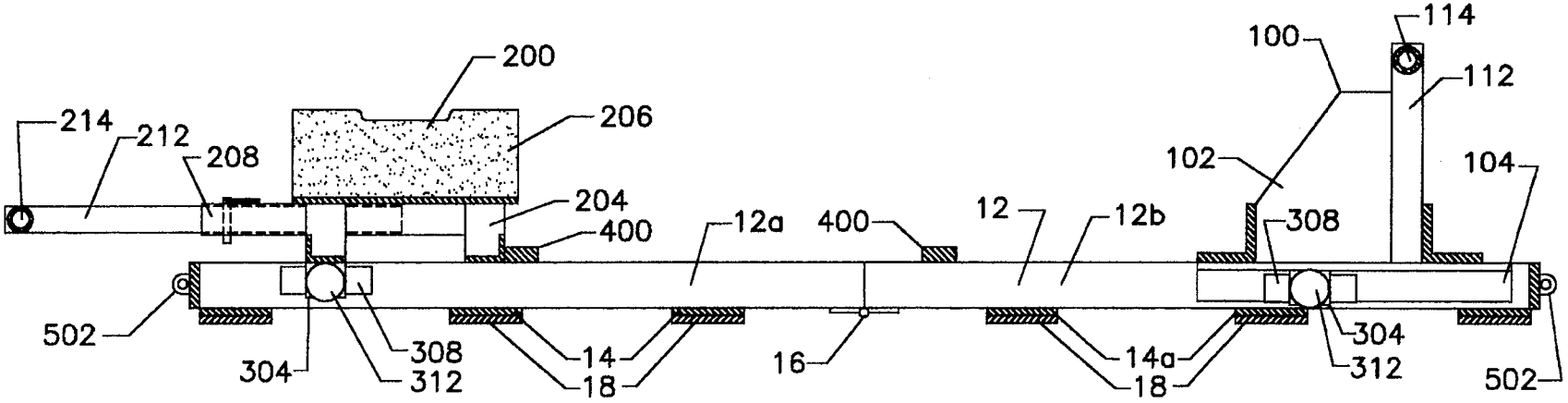
FIG. 2 is a cross-section view of the exercise devise of the present invention taken along line 2—2 in FIG. 1.
Figure 3:
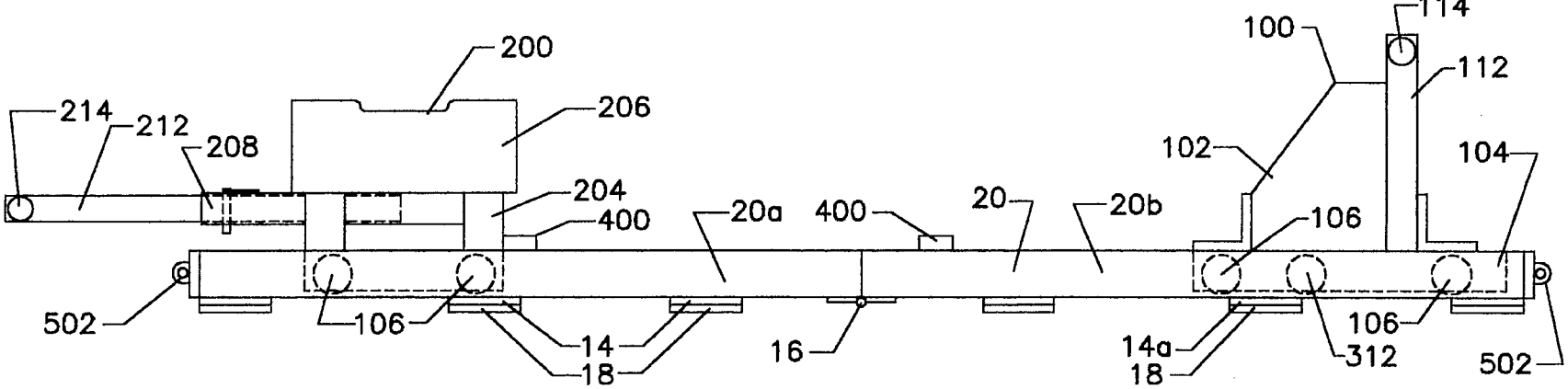
FIG. 3 is a top plan view of the exercise device of the present invention.

The two channels 10 and 12 are positioned in parallel relation with one another with the openings to the two channels facing each other as seen in FIG. 2. The two channels 10 and 12 receive the hand grip unit 100 and the knee rest unit 200 each described below.

The two channels are connected to one other by a series of cross-members 14 and 14*a*. Located at the bottom of each cross member 14 and 14*a* are feet 18, one at each end of the particular cross member 14 and 14*a*. The feet 18 prevent the exercise device from scuffing a floor surface. The feet 18 are made from any non-scuff material such as rubber or neoprene.

Figure 8:
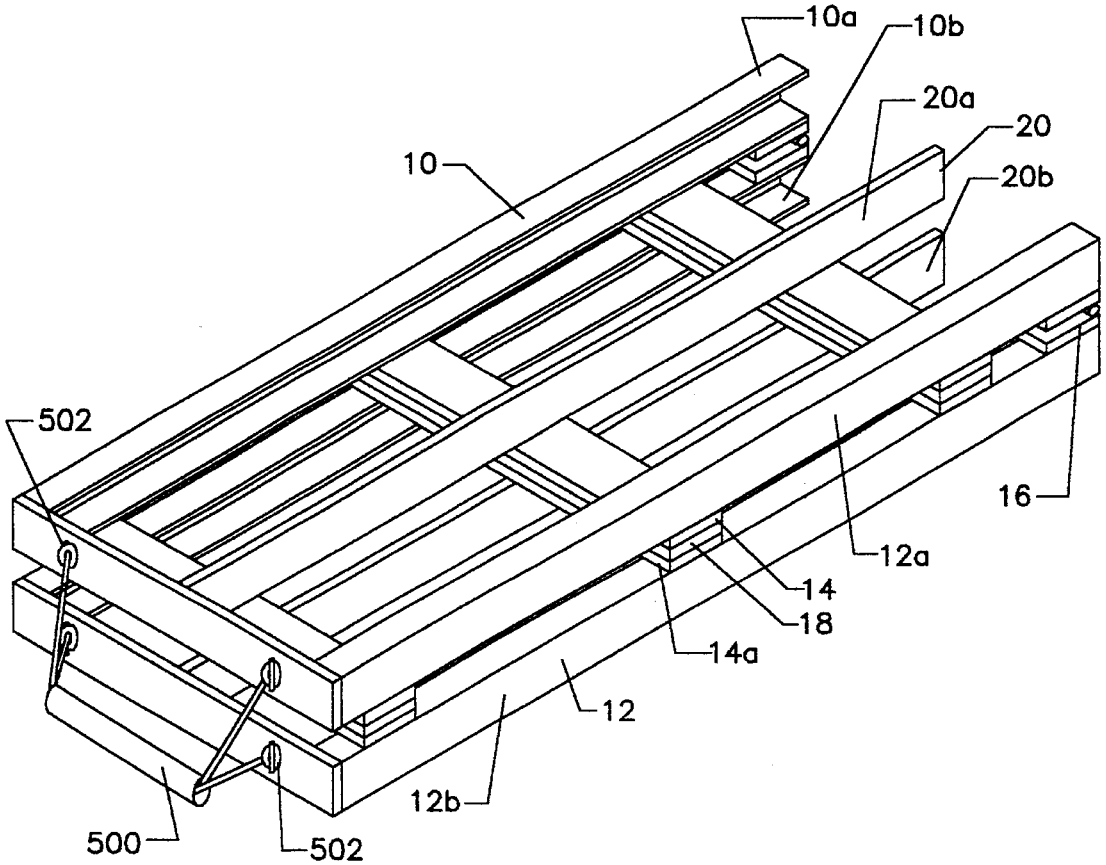
FIG. 8 is a perspective view of the exercise device in a back-to-back folded relationship Similar reference numerals refer to similar parts throughout the several views of the drawings.

The two center cross-members, each numbered 14*a*, are connected to each other by hinge means 16. The hinge means 16 allows the two channel components 10*a* and 10*b* of the first channel 10 and the two channel components 12*a* and 12*b* of second channel 12 to collapsed into a back-to-back folded relationship (as illustrated in FIG. 8) for easy storage and transportation, and opened into an end-to-end extended position for exercise use.

Centrally located on the top of the cross members 14 and 14*a* is a brake bar 20. The brake bar 20 is a thin raised rail that receives the variable resistance means 300 of the hand grip unit 100 and the knee rest unit 200. The variable resistance means 300 is described below.

The brake bar 20 is positioned parallel to the first channel 10 and the second channel 12 and runs the length of the exercise devise 1. The brake bar 20 is also composed of two brake bar components 20*a* and 20*b* to permit collapsing of the exercise device 1 as described above.

The hand grip unit 100 consists of a base member 102. Attached to the underside of the base member 102 are two angle bars 104, one on each side of the base member 102. The angle bars 104 each extend the length of the base member 102. Located at the end of each angle bar 104 is a hole (not illustrated) An axle (not illustrated) passes through each hole. Attached to the outer end of each axle is a caster 106. The other end of each axle is secured to the angle bar 104 by appropriate means such as a hex nut 108. A spacer 110 separates the caster 106 from the angle bar 104.

The casters 106, four in total, two per angle bar 104, are received within the two channels 10 and 12. Two casters 106 are received within the first channel 10 and two casters 106 are received within the second channel 12. The casters 106 permit the hand grip unit 100 to roll freely up and down the length of the channels 10 and 12.

Figure 4:
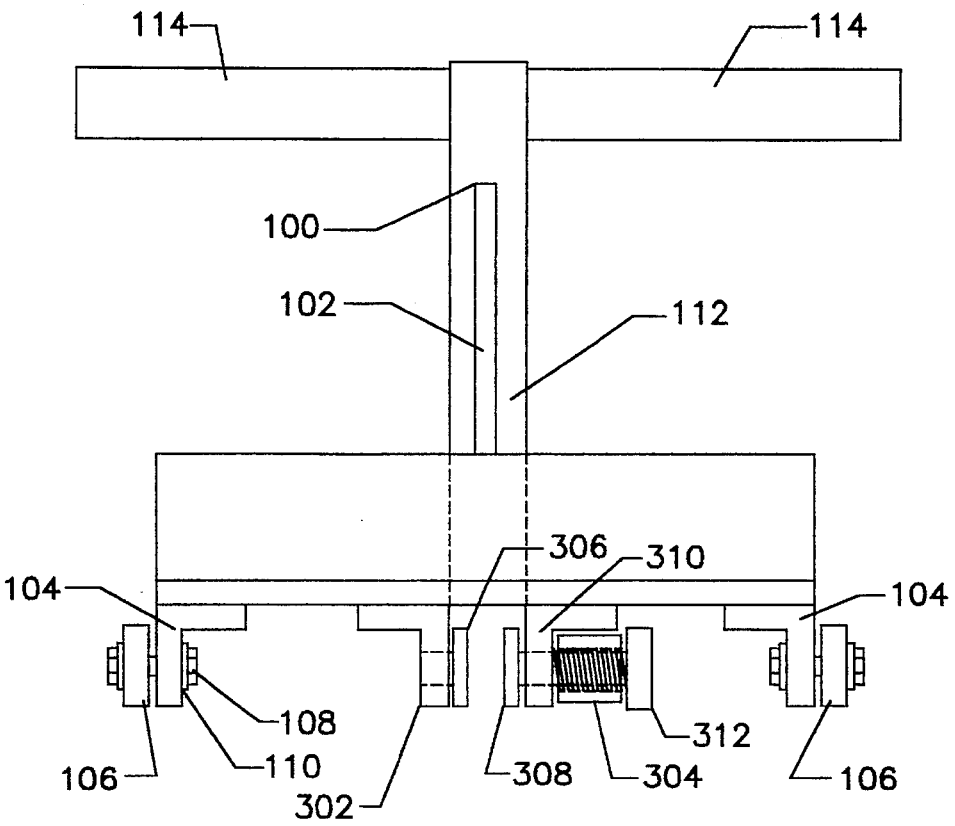
FIG. 4 is a back elevation view of the hand grip unit of the exercise device of the present invention.
Figure 5:
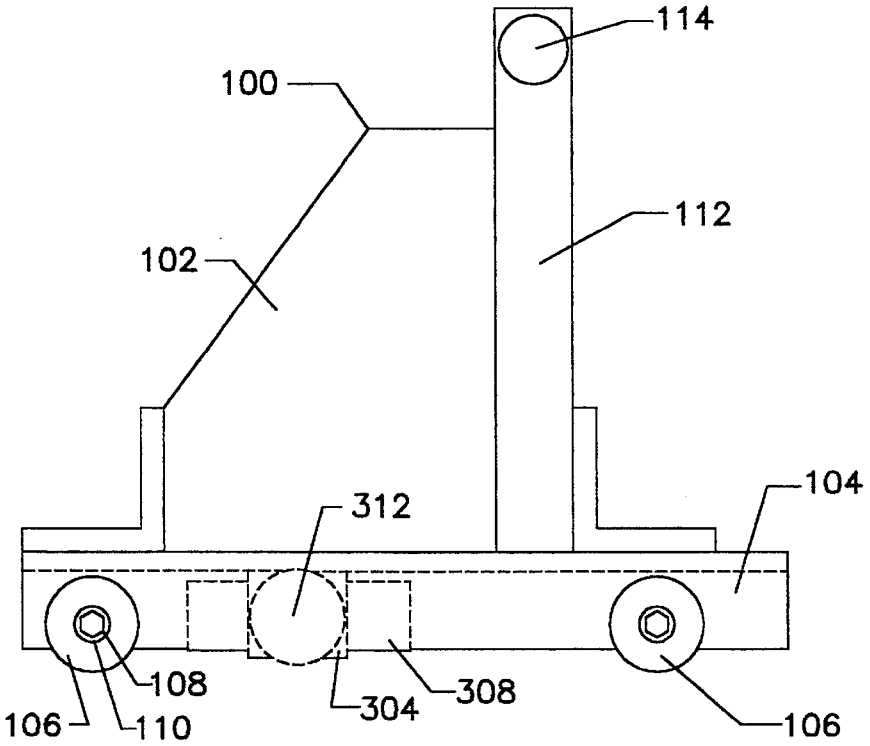
FIG. 5 is a side elevation view of the hand grip unit of the exercise device of the present invention.

Also attached to the underside of the base member 102 is the variable resistance means 300. As seen in FIG. 4, the variable resistance means 300 consists of an angle bar 302 and a vertical bar 304. The angle bar 302 and the vertical bar 304 attach to the base member 102 of the hand grip unit 100. Attached to the angle bar 302 is a first drag brake 306.

The vertical bar 304 has two large holes (not illustrated) passing through it on either end and a small threaded hole (not illustrated) passing through the center. A spring (not illustrated) passes through each large hole while a partially threaded pin (not illustrated) passes through the small hole.

One end of each spring attaches to a second drag brake 308. The other end of each spring attach to a spring plate 310. One end of the threaded post is attached to the second drag brake 308 while the other end is attached to a knob 312.

When the hand grip unit 100 is properly positioned within the two channels 10 and 12, the first drag brake 306 and the second drag brake 308 straddle the brake bar 20.

Twisting of the knob 312 in one direction causes the partially threaded pin to pass through the knob toward the second drag brake 308. This causes pressure on the spring plate 310, pushing the spring plate 310 toward the second drag brake 308. The spring plate 310 presses on the springs which push the second drag brake 308 onto the brake bar. Thus, the first drag brake 306 and the second drag brake 308 contact the brake bar 20.

The first drag brake 306 and the second drag brake 308 are made from a material having a high coefficient of friction. Leather will prove satisfactory. Other materials may also be used. By pressing the two drag brakes 306 and 308 onto the brake bar 20, the high coefficient of friction of the drag brake increases the drag force experienced by the hand grip unit 100 as it slides up and down the two channels 10 and 12. This increases the energy required to roll the hand grip unit 100 up and down the two channels 10 and 12. This increases the strenuousness of the workout for the user.

Further turning of the knob further increases the pressure of the drag brakes 306 and 308 onto the brake bar 20 thereby further increasing drag force experienced by the hand grip unit 100 as is slides up and down the channels.

Turning the knob 312 in the opposite direction causes a reversal of the above process and decreases the roll resistance of the hand grip unit.

Attached to the top side of the base member 102 of the hand grip unit is a vertical upright 112. Extending horizontally outward from the top of the vertical upright 112 are a pair of hand grips 114. The user grasps the hand grips 114. The hand grips 114 may be padded for user comfort. Rubber, fabric, or other suitable materials can be used for this purpose.

The knee rest unit 200 consists of a base member 202. The underside of the base member 202 of the knee rest unit 200 is identical in design and function to the underside of the base member 102 of the hand grip unit 100. This includes having the four casters on two angle bars as well as having a variable resistance means 300.

Extending upwardly from the base member 202 of the knee rest unit 200 are four vertical supports 204, one at each corner of the base member 202. Attached to the top of the vertical supports 204 is a knee rest 206. The knee rest 206 is a solid member that has a cushioned top surface for user comfort. The knee rest 206 receives the user's knees.

Attached to the underside of the knee rest 206 is a hollow tube 208. The hollow tube 208 extends beyond the back end (that end that faces away from the hand grip unit 100) of the knee rest 206. At the outer end of hollow tube 208 on the top surface thereof, is a first hole 210. A second hole (not illustrated) is located on the bottom surface of hollow tube 208 and is aligned with the first hole 210.

Received within the hollow tube 208 is a T-bar 212. The T-bar 212 slides into and out of the hollow tube 208. The twin prongs 214 of the T-bar 212 receive the feet of the user. Located on the top surface of the shaft 216 of the T-bar 212 is a series of holes 218. A second set of corresponding holes (not illustrated) is located on the bottom surface of the T-bar shaft 216.

The user selects the desired distance of T-bar extension from the hollow tube 208, and aligns the holes 210 of the hollow tube 208 with the appropriate holes 218 of the T-bar shaft 216. A pin 220 is inserted through the four aligned holes to hold the T-bar 212 stationary.

In order to utilize the exercise device of the present invention, the user places his knees on the knee rest 206. The user adjusts the T-bar 212 on the knee rest unit 200 so that the T-bar 212 comfortably receives the user's feet. The user selects whether to maintain the knee rest unit 200 or the hand grip unit 100 in a stationary position.

Figure 6:
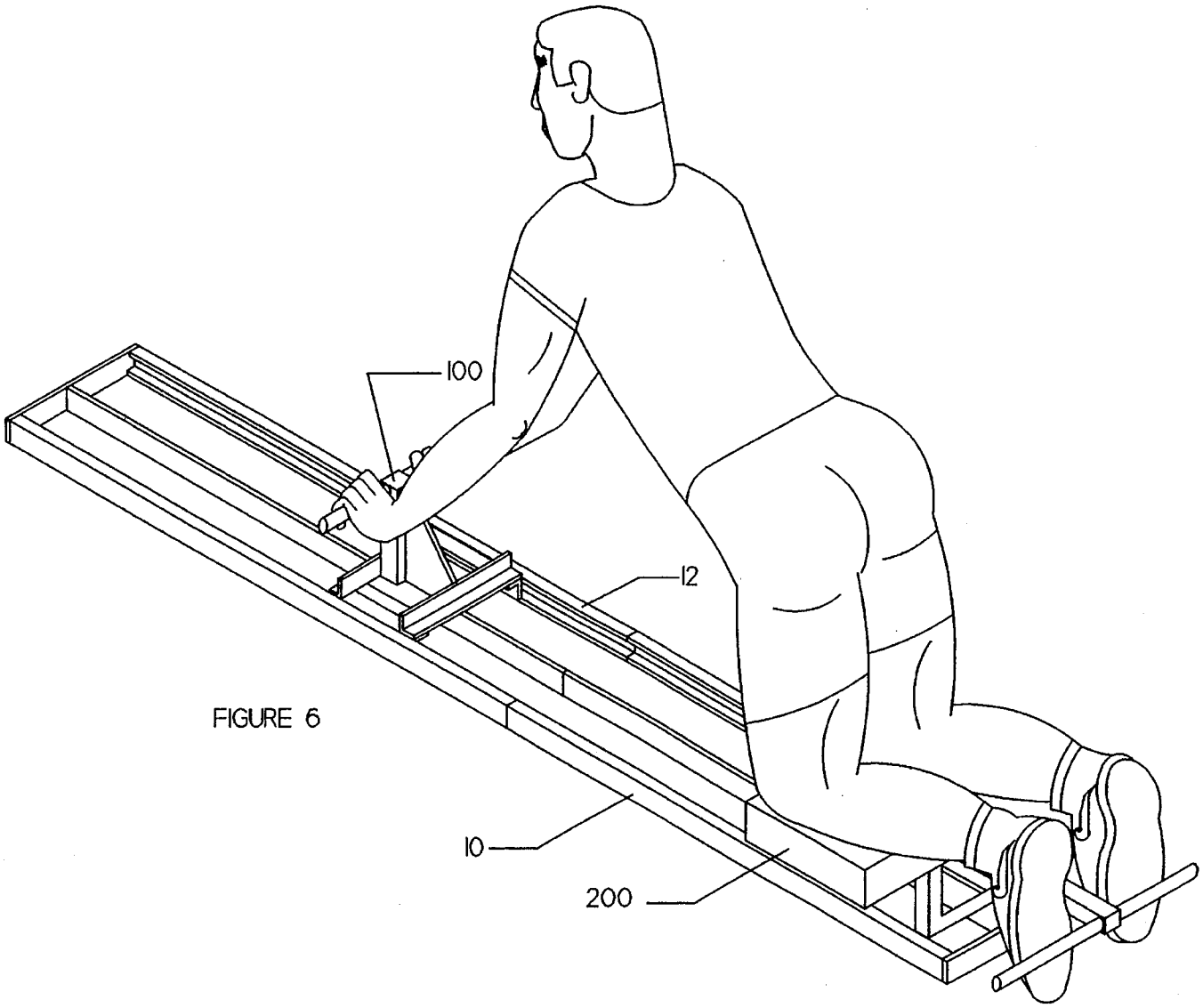
FIG. 6 is a perspective view of a user utilizing the exercise devise in a retracted position.
Figure 7:
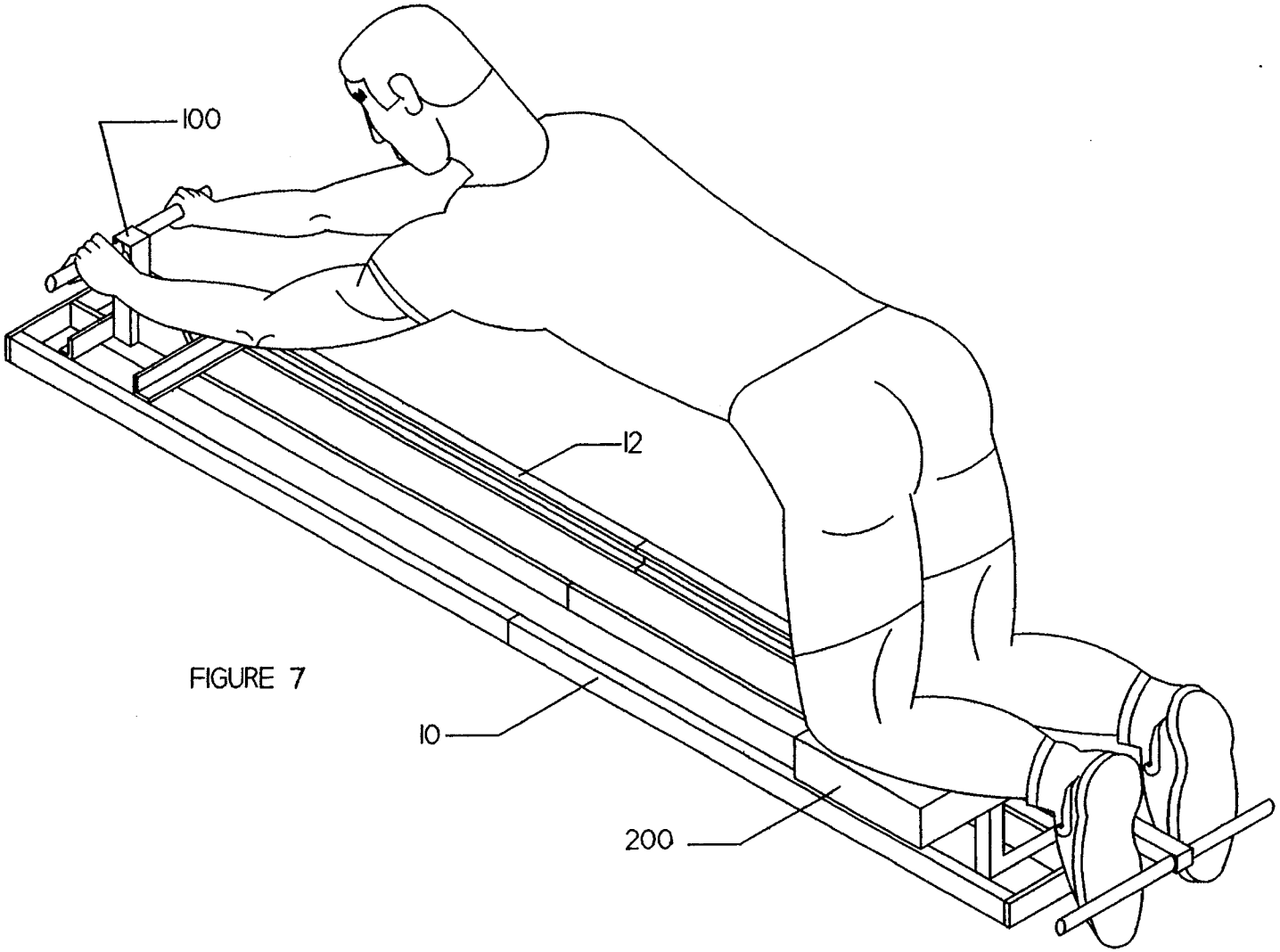
FIG. 7 is a perspective view of a user utilizing the exercise devise in an extended position.

Thereafter, the user slides the selected non-stationary unit (the hand grip unit 100 in FIG. 6) away from the stationary unit by extension of the user's body. Thereafter, the user slides the selected non-stationary unit back toward the stationary unit, as in FIG. 7 by retraction of the user's body. These actions are then repeated, thereby exercising the user's body.

A unit restraint bar 400 is employed to keep a unit stationary. The unit restrain bar 400 is extends from the first channel 10 to the second channel 12. Clamps, one at each end of the unit restraint bar 400, are used to secure the unit restrain bar 400 to the two channels 10 and 12.

The placement of the unit restrain bar 400 in the path of one of the units (either hand grip unit 100 or knee rest unit 200) prevents that unit from proceeding beyond the unit restrain bar 400. Placing one unit restrain bar 400 directly in front of a unit and a second unit restrain bar 400 directly behind the unit will prevent any movement of that unit, either forward or backward, thereby holding the unit stationary.

The unit restrain bar 400 may also be used to limit the range of motion of the non-stationary unit. Either the extension range of motion, the retraction range of motion, or both may be limited by the unit restrain bar 400.

If the hand grip unit 100 is to be kept stationary and the knee rest unit 200 is to roll freely (or with variable resistance), the user exercises the lower abdominal muscles (Rectus Abdominus), the lower back muscles (Oblique Externus), the buttocks (Gluteus Maximus), the calf (Gastrocnemius), and the back of the upper leg (Biceps Femoris).

If the knee rest unit 200 is to be kept stationary and the hand grip unit 100 is to roll freely (or with variable resistance), the user exercises the upper abdominals (External Oblique), the forearms (Brachioradialis), the upper back (Latissimus Dorsi), the chest and shoulders (Pectorals Majors, Trapezius), the upper arms (Biceps, Triceps, Deltoids), upper sides (Intercostalis) and the upper frontal legs (Vastus Lateralis, Vastus Medialis, Quadriceps Femoris, Sartorius).

For easy transportation, the hand grip unit 100 and the knee rest unit 200 can each be slid out of the channels 10 and 12. The exercise device 1 can then be folded back-to-back. Appropriate means, such as a clip 502, can be used to hold the exercise device 1 in a back-to-back relationship. A handle 500 can be located on the invention for easy carrying.

In order to use the exerciser 1, the device is unfolded into an end-to-end relationship. The hand grip unit 100 and the knee rest unit 200 are slid back into the channels 10 and 12. One of the units (either hand grip unit 100 or the knee rest unit 200) is secured into a stationary position, variable resistance is optionally applied, and user begins exercising.

While the invention has been particularly shown and described with reference to an embodiment thereof, it will be understood by those skilled in the art that various changes in form and detail may be made without departing from the spirit and scope of the invention.

I claim:

1. An apparatus for physical exercise comprising:

A frame member, said frame member including;

a first channel member, a second channel member oriented parallel to the first channel member, a plurality of spaced-apart cross members connecting the first channel member to the second channel member;

a hand grip carriage slidably engaged within the first and second channel members, a substantially vertically extending T-bar located on and attached to the hand grip carriage the T-bar being graspable by a user's hands, a first variable frictional resistance means having means for adjusting the coefficient of friction exerted on the hand grip carriage as it slides within the first channel member and the second channel member, a knee rest carriage having a front end facing the hand grip carriage and a rear end for receiving the user's knees, slidably engaged within the first and second channel members; a second T-bar attached to and extending substantially horizontally from the rear end of the knee rest carriage, for receiving the user's feet, a second variable frictional resistance means having means for adjusting the coefficient of friction exerted on the knee rest carriage as it slides within the first and second channel members; and a plurality of unit restraint means for optionally restraining either the movement of the hand grip carriage or the knee rest carriage.

2. The device as in claim 1 wherein the first T-bar is padded.

3. The device as in claim 1 wherein the second T-bar is padded.

4. The device as in claim 1 to further including means for adjusting the extension length of the first T-bar.

5. The device as in claim 1 to further including means for adjusting the extension length of the first T-bar.

* * * * *